US006402585B1

(12) United States Patent
Gatto et al.

(10) Patent No.: US 6,402,585 B1
(45) Date of Patent: Jun. 11, 2002

(54) BREAST SUPPORT SYSTEM

(76) Inventors: Josephine Gatto, 5160 W. 64th Pl.; Maureen A. Hayes, 6034 W. 64th St., both of Chicago, IL (US) 60638

( * ) Notice: Subject to any disclaimer, the term of this patent is extended or adjusted under 35 U.S.C. 154(b) by 0 days.

(21) Appl. No.: 09/736,681

(22) Filed: Dec. 13, 2000

(51) Int. Cl.[7] ..... A41C 3/00
(52) U.S. Cl. ..... 450/53; 450/57
(58) Field of Search ..... 450/41, 47, 51–53, 450/60, 61, 38–40, 55–57, 81, 88, 93; 2/267, 463, 455; 602/19, 60, 61

(56) References Cited

U.S. PATENT DOCUMENTS

| | | | | | |
|---|---|---|---|---|---|
| 336,413 | A | * | 2/1886 | Karp | 450/41 |
| 2,061,402 | A | * | 11/1936 | Hollar | 450/57 |
| 2,604,625 | A | * | 7/1952 | Gruber | 450/41 |
| 2,793,369 | A | * | 5/1957 | Panighini | 450/41 |
| 3,021,845 | A | * | 2/1962 | Smith | 450/57 |
| 3,196,460 | A | * | 7/1965 | Halstead | 450/41 |
| 3,351,954 | A | * | 11/1967 | Chalfin et al. | 450/41 |
| 3,503,404 | A | * | 3/1970 | Evers | 450/41 |
| 3,620,222 | A | | 11/1971 | Block | |
| 3,934,593 | A | | 1/1976 | Mellinger | |
| 4,298,008 | A | * | 11/1981 | Kylberg | 450/57 |
| 4,343,313 | A | | 8/1982 | Le Jeune | |
| 4,816,004 | A | | 3/1989 | Emanuel | |
| 4,992,074 | A | | 2/1991 | Diaz | |
| 5,098,330 | A | | 3/1992 | Greenberg | |
| 5,334,082 | A | | 8/1994 | Barker | |
| 5,347,656 | A | | 9/1994 | Fabritz et al. | |
| 5,522,892 | A | | 6/1996 | Lin | |
| D383,591 | S | | 9/1997 | Hyde | |
| 5,697,830 | A | * | 12/1997 | White | 450/36 |
| 5,755,611 | A | | 5/1998 | Noble et al. | |
| 5,833,515 | A | | 11/1998 | Shahbazian et al. | |
| 5,951,367 | A | | 9/1999 | Hsu | |
| 5,967,877 | A | | 10/1999 | Howard | |
| 5,997,380 | A | | 12/1999 | Yang | |
| 6,015,332 | A | | 1/2000 | Lee et al. | |

* cited by examiner

*Primary Examiner*—Gloria M. Hale
(74) *Attorney, Agent, or Firm*—Michael R. McKenna

(57) ABSTRACT

A breast support system for a large breasted woman that is used in conjunction with a brassiere to uplift and laterally displace the breasts. The unique design redistributes the weight of the breasts, so that the back and neck fatigue normally experienced by women with large breasts is relieved.

18 Claims, 2 Drawing Sheets

FIG. 1
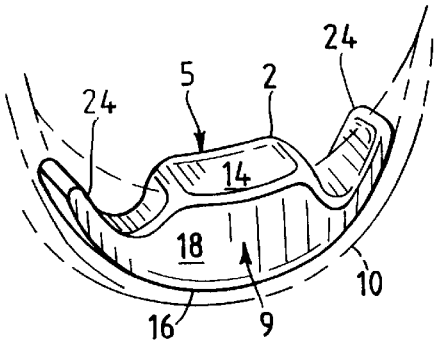
FIG. 4
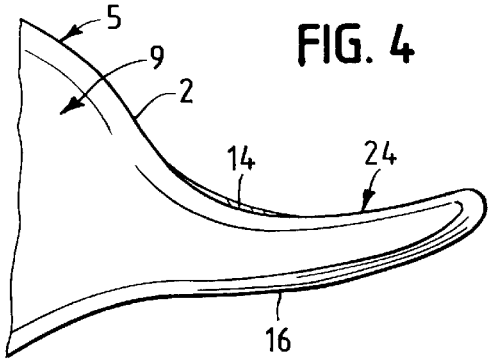
FIG. 2
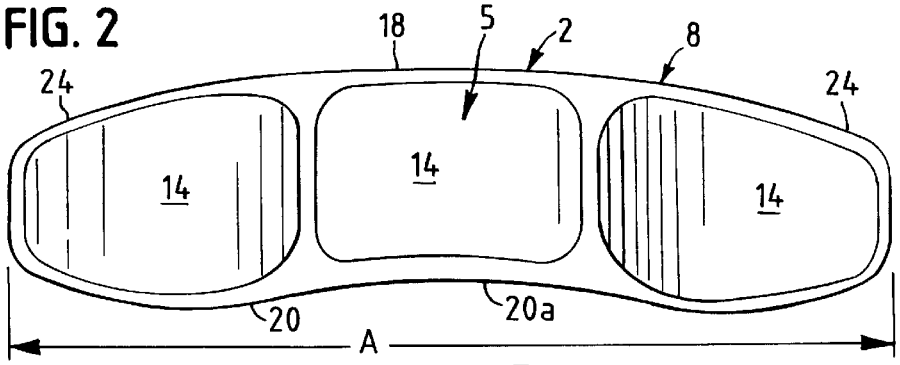
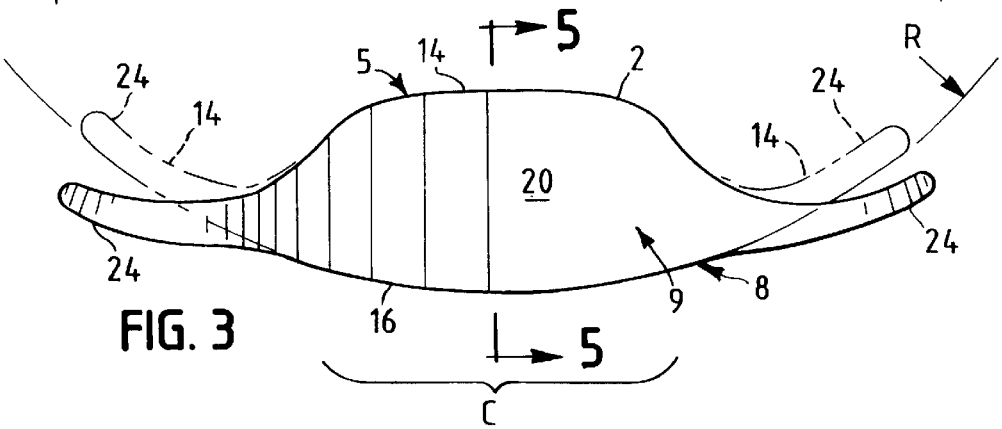
FIG. 3
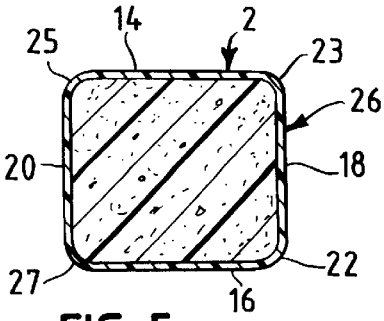
FIG. 5
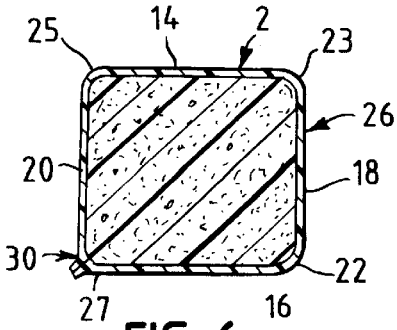
FIG. 6

BREAST SUPPORT SYSTEM

BACKGROUND OF THE INVENTION

This invention relates to a breast support system for a large breasted woman that is used in conjunction with a brassiere to uplift and laterally displace the breasts. Women with large breasts have a great deal of weight to bear and such weight contributes to back and neck fatigue. To alleviate this problem, and others which will become apparent from the disclosure which follows, the present invention conveniently redistributes the weight of the breasts laterally, whereby the back and neck fatigue normally experienced by women with large breasts is relieved.

Alternative technology is available in the form of a push-up bra which uses a flexible pouch insert disclosed in U.S. Pat. No. 6,015,332 issued on Jan. 18, 2000 to Lee et al. U.S. Pat. No. 5,098,330 issued in 1992 to Greenberg discloses a bra including enhancement means comprising a brassiere with an inner pocket for receiving a pad to support and uplift breast. U.S. Pat. No. 4,992,074 issued to Diaz in 1991 for a reusable self-supporting brassiere discloses a support which includes two foam elements which may be inserted underneath a conventional bra to provide additional support.

See further U.S. Pat. No. 4,816,004 issued in 1989 to Emanuel for a means for providing uplift support comprising a pad having a flat upper surface which is distinguishable from the instant invention. U.S. Pat. No. 5,967,877, issued to Howard in 1999 for a bra with reinforced contour line, discloses a support, which includes pads designed to uplift and augment breasts, for insertion in cups of a brassiere. Note however, that the shape is cup shaped with the rib along the lower edge of the periphery. Further, U.S. Pat. No. 5,334,082 issued to Barker in 1994 for a brassiere with augmenting bust support comprises a pillow for augmenting and uplifting a user's breast with a crescent shape and a generally flat topped portion that may fit into a pocket into the brassiere.

The principal advantage of such devices is breast enhancement. None of the foregoing teaches means for uplifting and laterally displacing a breast to relieve fatigue. Another disadvantage to all of the foregoing devices is that they do not provide for a means of flexibly conforming to a plurality of bra cups inherent in uniquely designed brassieres.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

The breast support system of this important invention uplifts, laterally displaces and redistributes the weight of the breast so that the back and neck fatigue normally experienced by women with large breasts is relieved. This is achieved with the unique design which allows the laterally extended portions of the breast to rest on the top surface portion with downward sloping sides of a central bulge of the apparatus. Moreover, the means for uplifting and laterally displacing is substantially incompressible. Its constancy acts uniformly on the breast use after use. While the preferred embodiments addressed herein relate generally to an externally applied means for uplifting and laterally displacing, the unique functional shape of the elongated body could be permanently implanted under the skin to uplift and laterally displace the breast when used in conjunction with a brassiere.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Still other advantages will be apparent from the disclosure that follows.

SUMMARY OF THE INVENTION

The invention relates to a breast support system for a large breasted woman that is used in conjunction with a brassiere comprising means for uplifting and laterally displacing at least one breast. The means has a maximum transverse dimension "A" that is less by a predetermined amount than the maximum lateral dimension "B" of the at least one breast. The means is disposed proximate the under-base of the breast adjacent to the chest. The breast support system uplifts, laterally displaces and redistributes the weight of at least one breast. The means for uplifting and laterally displacing is substantially incompressible. The means has an elongated body with a prominent central bulge that slopes downwardly on its sides to allow a lateral portion of the breast to rest on the sides of the central bulge.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Preferred embodiments of the invention are described hereinafter with reference to the accompanying drawing wherein:

FIG. 1 is a perspective view of a breast support system of the present invention showing the shape of the elongated body with the lateral wings conforming to the inner surface of a cup of a brassiere (shown in phantom);

FIG. 2 is a top elevation view of the elongated body of the current invention showing a convex forward surface and a centrally disposed concave portion of the back surface;

FIG. 3 is a side elevation view of the rear surface of the elongated body of the present invention showing the central bulge and lateral wings that flex;

FIG. 4 is an enlarged fragmentary view of a lateral end of the elongated body of the present invention showing a wing extending from the central bulge;

FIG. 5 is a cross-sectional view taken along the line 5—5 of FIG. 3 showing a rectangular cross-section of the central bulge and further showing a smooth covering surrounding the elongated body;

FIG. 6 is an alternative cross-sectional view of the central bulge of the elongated body taken along the line 5—5 of FIG. 3 showing a seam (30) along which the covering can be stitched;

DETAILED DESCRIPTION OF THE INVENTION

Figure 7:
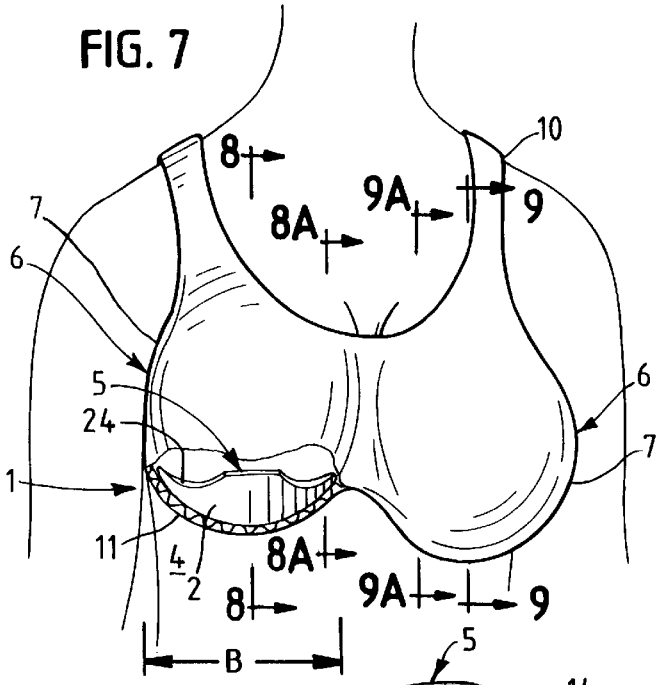
FIG. 7 is a fragmentary perspective view of the breast support system of the current invention showing the elongated body disposed in one of the cups of the brassiere (the other cup being without a support member)

The invention relates to a breast support system for a large breasted woman that is used in conjunction with a brassiere and comprises means for uplifting and laterally displacing at least one breast. The weight of the breasts is redistributed so that a woman wearing the breast support system with a brassiere will be relieved of the back and neck fatigue normally experienced by women with large breasts.

Without departing from the generality of the invention disclosed herein and without limiting the scope of the invention, the discussion that follows, will refer to the invention as depicted in the drawing.

Figure 8:
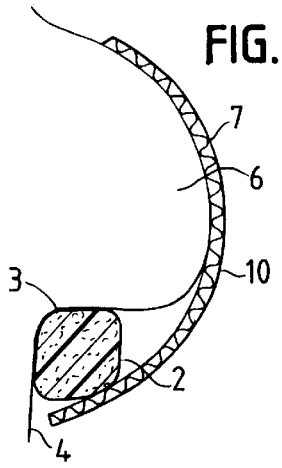
FIG. 8 is a partial cross-sectional view taken along line 8—8 of FIG. 7 showing a cross section of the elongated body relative to the breast inside the cup of the brassiere.
Figure 8A:
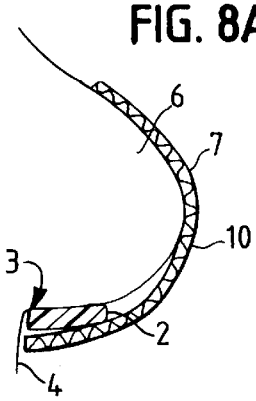
FIG. 8*a* is a partial cross-sectional view taken along line 8*a*—8*a* of FIG. 7 showing a cross section of the wing of the elongated body relative to the breast disposed within the cup of the brassiere.
Figure 9:
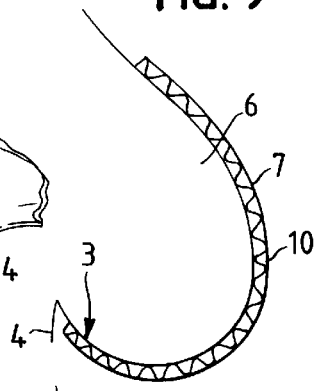
FIG. 9 is a partial cross-sectional view taken along the line 9—9 of FIG. 7 showing an unsupported breast in the cup of the brassiere.

The preferred embodiments of the apparatus depicted in the drawing comprise a breast support system 1 for a large breasted woman that is used in conjunction with a brassiere 10 comprising means for uplifting and laterally displacing 2 at least one breast 6, as shown in FIG. 7. The means has a maximum transverse dimension "A" that is less by a predetermined amount than the maximum lateral dimension "B" of the at least one breast. The means is disposed proximate the under-base 3 of the breast 6 adjacent to the chest 4. The breast support system uplifts, laterally displaces and redistributes the weight of at least one breast, as shown in FIGS. 7–9.

Figure 10:
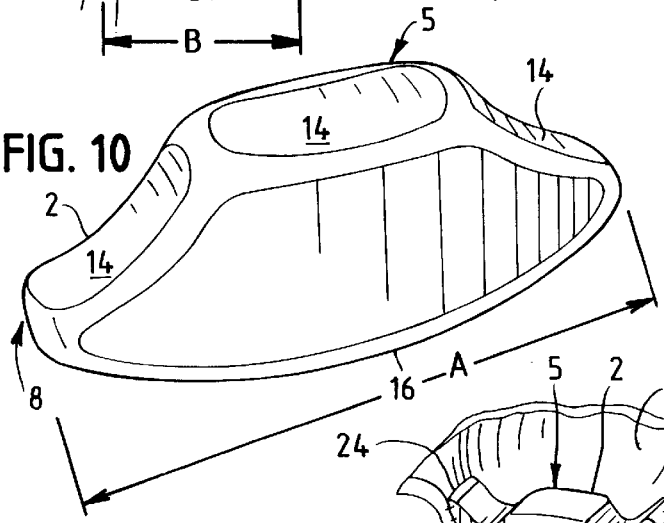
FIG. 10 is a perspective view of a preferred embodiment of the elongated body of the breast support system of the present invention without flexible lateral wings.

In a preferred embodiment of the breast support system for a large breasted woman that is used in conjunction with a brassiere, means for uplifting and laterally displacing at least one breast are provided. The means 2 has an elongated body 8 with a prominent central bulge 5. The central bulge has a maximum transverse dimension that is less by a predetermined amount than the maximum lateral dimension of the at least one breast 6 which can best be seen in FIGS. 7 and 10. The means 2 is disposed proximate the underbase 3 of the breast adjacent to the chest 4 and the at least one breast is uplifted and laterally displaced and the weight of at least one breast is redistributed. Furthermore, the means for uplifting and laterally displacing 2 is preferably substantially incompressible under the conditions in which it is employed. It is apparent that one elongated body should generally be used in each cup of the brassiere.

Figure 12:
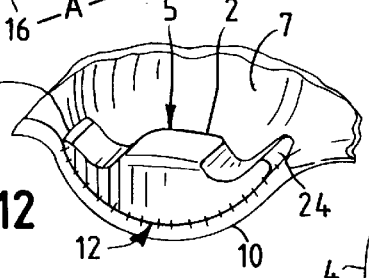
FIG. 12 is a fragmentary perspective view of the breast support system of the present invention with the elongated body integral with the brassiere through stitches.
Figure 9A:
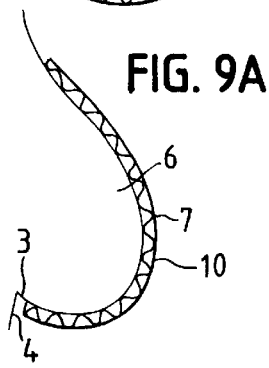
FIG. 9*a* is a partial cross-sectional view taken along the line 9*a*—9*a* of FIG. 7 showing the unsupported breast within the cup of the brassiere.

Preferably, the means for uplifting and laterally displacing is disposed in a cup 7 of the brassiere 10. The brassiere may be independent of an underwire which is commonly used to support a base edge 11 of the cup. Moreover, the means for uplifting and laterally displacing may be engageable in the cup of the brassiere. In a preferred embodiment, the means for uplifting and laterally displacing is an integral part of the brassiere as, for example, in FIG. 12 where it is stitched 12 to the brassiere 10.

As shown in FIGS. 1–3 of the drawing, the means for uplifting and laterally displacing 2 may comprise an elongated body 8, including a prominent central bulge 5, with a top surface 14 having an elevated protuberance 9 centrally disposed expressing the central bulge 5, a bottom surface 16 that is generally convex, a forward surface 18, and a back surface 20 with a central portion that is concave. The top surface 14 may have a forward edge connected to a top edge of the forward surface and a rear edge connected to a top edge of the back surface, and the bottom surface may have a forward edge connected to a bottom edge of the forward surface and a rear edge connected to a bottom edge of the back surface. Preferably, the concave central portion 20*a* of the back surface smoothly adapts to the contour of the chest. The central bulge 5 may have a maximum transverse dimension "C" that is less by a predetermined amount than the maximum lateral dimension of the at least one breast 6. Users will experience that the central bulge uplifts and redistributes the weight of die at least one breast when worn with a brassiere and the back and neck fatigue normally experienced by women with large breasts will be relieved.

Preferably, the breast support system may have the forward surface 18 convex, as shown in FIG. 2, and the bottom surface 16 convex, as shown in FIGS. 2–3 and 5–6. In this way, the bottom edge of the forward surface is adapted to smoothly lie in the cup of the brasserie.

Figure 11:
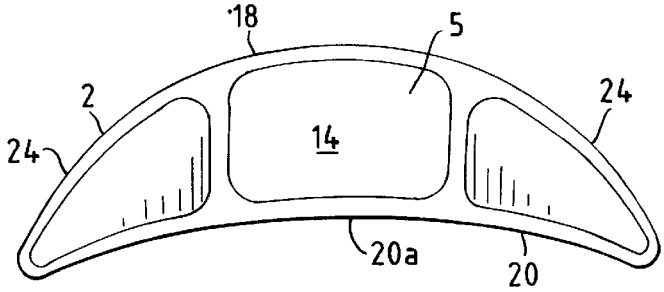
FIG. 11 is a top elevation view of a preferred embodiment of an elongated body with tapered wings designed for smaller breasted women.

Additionally, a preferred embodiment of the breast support system for a large breasted woman may have the elongated body 8 with a pair of wings 24, as shown in FIGS. 1–4, 7 and 11–12. Each of the wings 24 may be disposed laterally of the prominent central bulge 5 and the top surface 14 of the elongated body 8 proximate each of the flexible wings 24 can be lower than the top surface 14 associated with the central bulge 5 to allow a lateral portion of the breast 6 to rest thereon. Preferably, each of die pair of wings is flexible to more readily allow the bottom surface to conform with the contour of the cup of the brassiere, as shown in FIG. 3. As shown in FIG. 11, the wings may be tapered for smaller breasts and cup designs.

To provide a more natural experience of the breast support system of this important invention, the means for uplifting and laterally displacing I may comprise a lightweight and preferably floatable material that is buoyant when immersed in water. Ideally this will allow the user to engage in water sports when the breast support system is used in the cup of a bathing suit. While the breast support system may be constructed out of any lightweight material, a styrofoam is preferred as it is substantially incompressible and it floats.

For enhanced comfort, it may have a smooth covering 26 surrounding the floatable material as shown in FIGS. 5 and 6. Regardless of the core material, a smooth covering may be employed. One skilled in the art will appreciate that such a cover can be provided in any number of known ways, including being sewed on, as shown in FIG. 6, adhesively applied, or sprayed on for a smooth coating. Preferably the seam 30 can be esthetically minimized.

Alternatively, the unique functional shape of the elongated body could be permanently implanted under the skin to uplift and laterally displace the breast when used in conjunction with a brassiere. Traditionally used implant coverings and a variety of core materials could be employed, including foams, gels and various liquids. The covering required would maintain the permitted shapes of the implanted elongated body.

In another preferred embodiment of the breast support system 1 for a large breasted woman that is used in conjunction with a brassiere, means for uplifting and laterally displacing 2 at least one breast is included. Each elongated body 8 of the means 2, being disposed in a cup 7 of the brassiere proximate the under-base 3 of the breast 6 adjacent to the chest 4, has a maximum transverse dimension "A" that is less by a predetermined amount than the maximum lateral dimension "B" of the at least one breast. It has an elongated body 8, including a prominent central bulge 5, with a top surface 14 having an elevated protuberance 9 centrally disposed expressing the central bulge, a bottom surface 16 that is generally convex, a forward surface 18, and a back surface 20 with a central portion 20*a* that is concave. The top surface 14 has a forward edge 23 connected to a top edge of the forward surface 18 and a rear edge 25 connected to a top edge of the back surface 20, and the bottom surface 16 has a forward edge 22 connected to a bottom edge of the forward surface 18 and a rear edge 27 connected to a bottom edge of the back surface 20. The concave central portion 20*a* of the back surface 20 smoothly adapts to the contour of the chest 4.

The central bulge 5 of this embodiment has a maximum transverse dimension "C" that is less by a predetermined amount than the maximum lateral dimension "B" of the at least one breast and the elongated body 8 comprises a pair of wings 24. Each of the wings is disposed laterally of the prominent central bulge and the top surface 14 of the elongated body proximate each of the flexible wings 24 is lower than the top surface associated with the central bulge allowing a lateral portion of the breast to rest thereon, and each of the pair of wings 24 is flexible to more readily allow the bottom surface 16 to conform with the contour of die cup 7 of the brassiere 10. It also has a smooth covering. The central bulge 5 uplifts and redistributes the weight of the at least one breast, so that a woman wearing a brassiere with the support system experiences relief from back and neck fatigue. Preferably, the forward surface 18 is convex and the bottom surface 16 is convex so that the bottom edge of the forward surface smoothly lies in the cup of the brasserie.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scop of the present invention.

My invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A breast support system for a large breasted woman that is used in conjunction with a brassiere comprising means for uplifting and laterally displacing at least one breast, said means having a maximum transverse dimension that is less by a predetermined amount than the maximum lateral dimension of said at least one breast, said means being disposed in a cup of the brassiere proximate the under-base of the breast adjacent to the chest, said means for uplifting and laterally displacing comprises a smooth covering, said means for uplifting and laterally displacing comprises an elongated body, including a prominent central bulge, with a top surface having an elevated protuberance centrally disposed expressing the central bulge, a bottom surface that is generally convex, a forward surface, and a back surface with a central portion that is concave, the top surface has a forward edge connected to a top edge of the forward surface and a rear edge connected to a top edge of the back surface, and the bottom surface has a forward edge connected to a bottom edge of the forward surface and a rear edge connected to a bottom edge of the back surface, said concave central portion of the back surface smoothly adapts to the contour of the chest, said central bulge having a maximum transverse dimension that is less by a predetermined amount than the maximum lateral dimension of said at least one breast, said elongated body comprises a pair of wings, each of said wings is disposed laterally of the prominent central bulge and the top surface of the elongated body proximate each of the flexible wings is lower than the top surface associated with the central bulge allowing a lateral portion of the breast to rest thereon, and each of the pair of wings is flexible to more readily allow the bottom surface to conform with the contour of the cup of the brassiere, said central bulge uplifts and redistributes the weight of the at least one breast, whereby, a woman wearing a brassiere with the means for uplifting and laterally displacing experiences relief from back and neck fatigue.

2. The breast support system for a large breasted woman of claim 1, wherein the forward surface is convex and the bottom surface is convex, whereby, the bottom edge of the forward surface is adapted to smoothly lie in the cup of the brasserie.

3. A breast support system for a large breasted woman that is used in conjunction with a brassiere comprising means for uplifting and laterally displacing at least one breast, said means having a maximum transverse dimension that is less by a predetermined amount than the maximum lateral dimension of said at least one breast, said means being disposed proximate the under-base of the breast adjacent to the chest, whereby, said at least one breast is uplifted and laterally displaced and the weight of at least one breast is redistributed, and wherein the means for uplifting and laterally displacing is independent of an underwire and is disposed in a cup of the brassiere.

4. A breast support system for a large breasted woman that is used in conjunction with a brassiere comprising means for uplifting and laterally displacing at least one breast, said means having an elongated body with a prominent central bulge, said central bulge having a maximum transverse dimension that is less by a predetermined amount than the maximum lateral dimension of said at least one breast, said means being disposed proximate the under-base of the breast adjacent to the chest, whereby, said at least one breast is uplifted and laterally displaced and the weight of at least one breast is redistributed.

5. The breast support system for a large breasted woman of claim 4, wherein the means for uplifting and laterally displacing is substantially incompressible.

6. The breast support system for a large breasted woman of claim 4, wherein the means for uplifting and laterally displacing is disposed in a cup of the brassiere.

7. The breast support system for a large breasted woman of claim 4, wherein the means for uplifting and laterally displacing is engageable in the cup of the brassiere.

8. The breast support system for a large breasted woman of claim 4, wherein the means for uplifting and laterally displacing is an integral part of the brassiere.

9. The breast support system for a large breasted woman of claim 4, wherein the means for uplifting and laterally displacing comprises a smooth covering.

10. A breast support system for a large breasted woman that is used in conjunction with a brassiere comprising means for uplifting and laterally displacing at least one breast, said means having a maximum transverse dimension that is less by a predetermined amount than the maximum lateral dimension of said at least one breast.

said means being disposed proximate the under-base of the breast adjacent to the chest.

whereby, said at least one breast is uplifted and laterally displaced and the weight of at least one breast is redistributed, and wherein the means for uplifting and laterally displacing comprises an elongated body, including a prominent central bulge, with a top surface having an elevated protuberance centrally disposed expressing the central bulge, a bottom surface that is generally convex, a forward surface, and a back surface with a central portion that is concave, the top surface has a forward edge connected to a top edge of the forward surface and a rear edge connected to a top edge of the back surface, and the bottom surface has a forward edge connected to a bottom edge of the forward surface and a rear edge connected to a bottom edge of the back surface, said concave central portion of the back surface smoothly adapts to the contour of the chest, said central bulge having a maximum transverse dimension that is less by a predetermined amount than the maximum lateral dimension of said at least one breast, said central bulge uplifts and redistributes the weight of the at least one breast, whereby, a woman wearing a brassiere with the means for uplifting and laterally displacing experiences relief from back and neck fatigue.

11. The breast support system for a large breasted woman of claim 10, wherein the forward surface is convex and the bottom surface is convex, whereby, the bottom edge of the forward surface is adapted to smoothly lie in the cup of the brasserie.

12. The breast support system for a large breasted woman of claim 10, wherein the elongated body comprises a pair of wings, each of said wings is disposed laterally of the prominent central bulge and the top surface of the elongated body proximate each of the flexible wings is lower than the top surface associated with the central bulge allowing a lateral portion of the breast to rest thereon.

13. The breast support system for a large breasted woman of claim 11, wherein each of the pair of wings is flexible to more readily allow the bottom surface to conform with the contour of the cup of the brassiere.

14. A breast support system for a large breasted woman that is used in conjunction with a brassiere comprising means for uplifting and laterally displacing at least one breast, said means having a maximum transverse dimension that is less by a predetermined amount than the maximum lateral dimension of said at least one breast, said means being disposed proximate the under-base of the breast adjacent to the chest, whereby, said at least one breast is uplifted and laterally displaced and the weight of at least one breast is redistributed, and wherein the means for uplifting and laterally displacing comprises a floatable material.

15. The breast support system for a large breasted woman of claim 14, wherein the means for uplifting and laterally displacing comprises a smooth covering surrounding the floatable material.

16. The breast support system for a large breasted woman of claim 14, wherein the floatable material comprises a styrofoam.

17. A breast support system for a large breasted woman that is used in conjunction with a brassiere comprising means for uplifting and laterally displacing at least one breast;

said means having a maximum transverse dimension that is less by a predetermined amount than the maximum lateral dimension of said at least one breast;

said means being disposed proximate the under-base of the breast adjacent to the chest;

whereby, said at least one breast is uplifted and laterally displaced and the weight of at least one breast is redistributed, and wherein the means for uplifting and laterally displacing is disposed in a cup of the brassiere that is independent of an underwire.

18. The breast support system for a large breasted woman of claim 17, wherein the means for uplifting and laterally displacing is substantially incompressible.

* * * * *